US005782375A

United States Patent [19]

McHenry et al.

[11] Patent Number: 5,782,375

[45] Date of Patent: Jul. 21, 1998

[54] DRAWN AND IRONED CANS OF A METAL-PLASTIC CONSTRUCTION AND THEIR FABRICATION PROCESS

[76] Inventors: Robert J. McHenry, 2819 Royal Ashdown Ct., St. Chalres, Ill. 60174; Dominique Petit, Les Cotes, F-38340 Pommiers-La-Placette, France

[21] Appl. No.: 656,333

[22] PCT Filed: Nov. 30, 1994

[86] PCT No.: PCT/US94/13922

§ 371 Date: Oct. 29, 1996

§ 102(e) Date: Oct. 29, 1996

[87] PCT Pub. No.: WO95/15226

PCT Pub. Date: Jun. 8, 1995

[30] Foreign Application Priority Data

Dec. 1, 1993 [FR] France ..... 93 14619

[51] Int. Cl.[6] ..... B65D 25/14

[52] U.S. Cl. ..... 220/450; 428/35.9; 428/461; 29/527.4; 426/126

[58] Field of Search ..... 220/450; 206/139; 428/35.9, 35, 458, 457, 461, 460; 156/224; 29/527.4

[56] References Cited

U.S. PATENT DOCUMENTS

| | | | |
|---|---|---|---|
| 3,760,751 | 9/1973 | Dunn et al. | 113/120 H |
| 4,339,483 | 7/1982 | Lieno et al. | 426/126 |
| 4,358,493 | 11/1982 | Ohtsuki et al. | 428/35 |
| 4,741,934 | 5/1988 | Terayama et al. | 220/450 |
| 5,181,409 | 1/1993 | Heyes et al. | 72/46 |
| 5,193,265 | 3/1993 | Muggli et al. | 29/527.4 |

FOREIGN PATENT DOCUMENTS

| | | |
|---|---|---|
| 0 115 103 | 8/1984 | European Pat. Off. . |
| 2 237 763 A | 5/1991 | United Kingdom . |

OTHER PUBLICATIONS

Iron & Steel, Feb. 1953, pp. 63–66, XP000579822; S.Y. Chung et al.: "Cylindrical Shells an Experimental Investigation into Redrawing".

*Primary Examiner*—Joseph M. Moy
*Attorney, Agent, or Firm*—Hill & Simpson

[57] ABSTRACT

The invention concerns drawn and ironed cans and their fabrication process starting from a stratified or laminated metal-plastic construction (1) including a foil of plastic material on which adheres two exterior metal foils and such that the ratio of the thickness of the plastic material to the total thickness of metal is greater than 0.5. The forming of this laminate into a can body (5) includes first of all drawing in one or several steps, then ironing, preferably in four successive passes. The cans are intended in particular to contain beverages. The advantage of the process resides in less cost of primary materials for usage characteristics as good as those of entirely metal cans.

32 Claims, 5 Drawing Sheets

FIG. 4
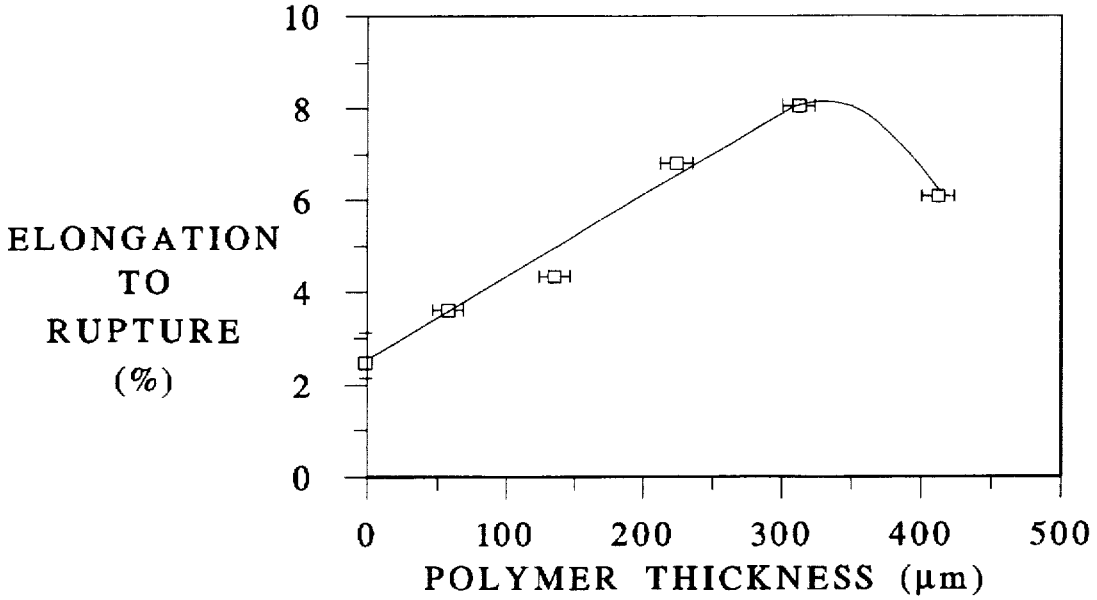
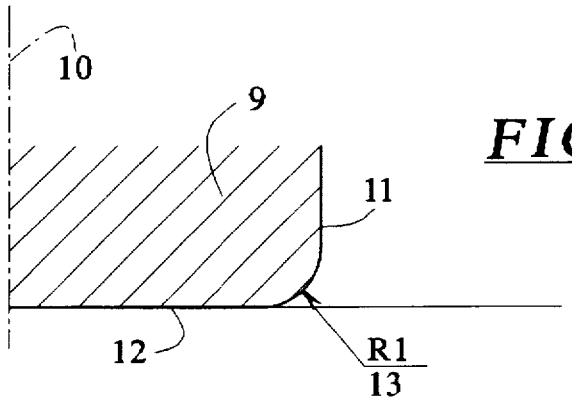
FIG. 5a
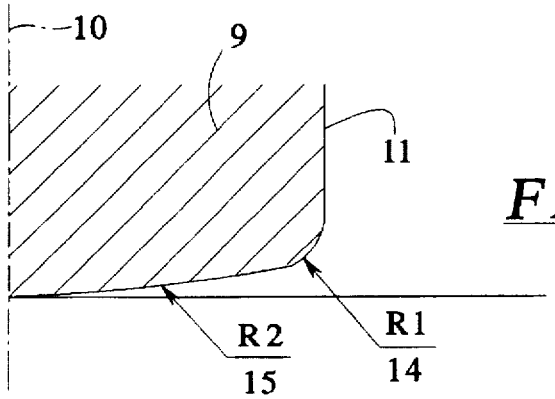
FIG. 5b

DRAWN AND IRONED CANS OF A METAL-PLASTIC CONSTRUCTION AND THEIR FABRICATION PROCESS

BACKGROUND OF THE INVENTION

The present invention generally relates to fabrication, by drawing and ironing, of cans for use in packaging of beverages or foods and containers for aerosols. More precisely, the present invention relates to new and improved metal-plastic laminate construction of the type including metal-polymer-metal, that is in which a layer of polymer is interposed between two metal sheets to which it is adhered.

Hereinafter, the terms metal-plastic-metal, metal-polymer-metal, or more simply the abbreviation MPM are used without particular distinction to identify the new and improved laminar materials of the present invention.

There are numerous documents describing layered metal-plastic constructions. The majority of these concern metal-polymer or poly-metal-polymer constructions, metal-polymer-metal constructions being rarer.

Of these documents that do mention MPM constructions, none teaches any preferred range of materials and thicknesses which are specially suitable for making drawn and ironed beverage or food cans.

By way of illustration, WO 82/00020, published on Jan. 7, 1982, describes a metal-plastic construction which in its simplest form includes a polyethylene (PE) film attached to a foil or plate of metal. Another embodiment includes two films of PE attached to opposite surfaces of a metal plate to form a-complex, PE-metal-PE. Finally, a third embodiment consists of two plates or foils of metals attached to opposite surfaces of a PE film. The PE used, obtained by copolymerization under a low pressure of ethylene and of butene-1, is of a linear low density type (LLDPE) having a density of between 0.91 and 0.94. The LLDPE described in this application, has the interesting property of adhering directly to the metal without needing to use an adhesive. It suffices to adhere it to the metal by the simultaneous application of heat and pressure (heat sealing).

The metallic substrates described in this application include: steel, steel having a coating of tin or of chrome or of chrome/oxide or of zinc, aluminum treated or not with nickel, copper, or zinc. It may have undergone a chemical conversion treatment.

Although there is no explicit teaching as to the desired absolute or relative examples of simple metal-plastic constructions, the published application describes films of different types of polyethylene of 100 microns thickness that are heat sealed onto the plates of different metals, such as steel, tin-plated steel, steel coated with chrome-chrome oxide, or aluminum of a thickness of 210 microns. The specimens obtained are then formed into hollow articles by folding, stamping, drawing, wall-ironing. The adhesion of the coatings is compared and demonstrates the superiority of linear low density polyethylene (LLDPE).

The French patent No. FR2 665 887 (Pechiney Emballage Alimentaire) describes a capsule to fit over a cork made by drawing, drawing and ironing, or flow turning, characterized in that it is comprised of two layers of aluminum bound together by an adhesive layer of Shore hardness less than 80. The adhesive layer can be constituted of an ethylene acrylic acid or of polyethylene, or of polypropylene modified with acid functionality. The total thickness of the complex is comprised between 120 and 400 microns with the following percentage distribution of the total thickness:

Outer layer of aluminum 20 to 50%

Adhesive layer 3 to 30%

Inner layer of aluminum 40 to 60%

European Patent Application EP-A-0 046 444 assigned to Schwerzerische Aluminum AG describes an MPM composite laminate foil in which the plastic layer could be as thick as the two metal layers combined. One stated requirement for achieving deep drawability is to select the plastic core layer and the metal surface layers such that when the composite is elongated, the load borne by the plastic core is greater than that borne by each of the metal strips. This condition is achieved by use of an oriented or stretched plastic layer. It is also stated that the soft or half-hard aluminum thin strip is particularly well suited. There is no teaching of drawing and ironing as a suitable process, but rather deep drawing and deep drawing by elongation, which are the conventional processes for such semi-rigid containers.

A similar approach to MPM constructions is described in European Patent Application EP-A-O 034 781 which is assigned to BASF Aktiengesellschaft. The inventors of that application roll the plastic film before combining it with the metal foil in order to give the plastic ductility properties which are more like selected metals.

A metal-plastic-metal structural laminate which can be formed into various useful articles is described in European Application EP-A-0134958 assigned to Dow Chemical Company. This invention is in part defined by a very wide range of thicknesses of the individual layers, of total thicknesses, and of ratio of thicknesses. It is further defined in terms of an ability of the laminate to withstand at least a certain level of stretch formability as measured in a standard laboratory test, the ability to be bent to a given sharp radius without metal rupture, and a certain level of thermal stability.

The patent does not contain any reference to any drawn or drawn and ironed shapes nor to the ability of these laminate constructions to be formed by either a drawing process or by a drawing and ironing process. The laboratory test described is a form of biaxial tension test in which the material is uniformly stretched while maintaining the periphery, fixed in such a way as to thin the material. While such a stretch forming process is conventionally used in forming shallow parts such as automotive panels, it is not used for making food or beverage cans. A conventional drawing process such as is used to make food cans or for the initial steps to make beverage cans allows the material to flow from the periphery and results in little or no thickness reduction.

U.S. Pat. No. 3,298,559, assigned to Continental Can Company, describes laminated metal-plastic containers, such as cake pans, which are cold drawn in conventional forming dies. Among the metal-plastic containers described are some which are of the MPM type. Although wide ranges of thicknesses of metal and of plastic are claimed, there is no teaching as to the importance of the ratio of these thicknesses. Those examples which cover MPM constructions have a ratio of plastic to total metal thickness of between 5 and 9. The metal layers in the MPM examples are described as dead-soft or zero temper. There is no indication that such containers can be formed by a drawing and ironing process or that drawn containers suitable for food cans can be made.

PROBLEM POSED

The problem presented to the inventors was that of the improvement of a can for gaseous beverages. Of a capacity in general of around 33 centiliters, of a cylindrical shape, this can is closed by an easy open end, coated internally by a food approved varnish and externally by one or several decorative layers indicating the nature and the brand of the product contained. These coatings are in general applied after the forming of the can.

The most frequently used forming process of these cans is the process of drawing and ironing. This process permits very rapid production cycles, which has permitted the enormous worldwide diffusion of this type of can.

This process, well known to one skilled in the art, is comprised as its name indicates by a first series of one or several passes of drawing and second series of one or several passes of ironing. One starts with a flat circular disc of steel or aluminum alloy of a thickness of around 300 microns. This disc is first drawn for forming an initial shallow cup with the aid of an apparatus represented by FIG. 1*a*. The initially flat disc (1) is shown there in the course of deformation. It is pressed between a fixed die plate (2) and a pressure plate (3). The descent of the punch (4) driven by a piston permits the formation of the cup which undergoes practically no decrease in thickness. The cup is then formed by a second drawing pass (FIG. 1*b*) where the designating numerals correspond to the same elements as on FIG. 1*a*.

The walls of this cup are then ironed by the aid of a series of ironing rings, generally three in number, of decreasing internal diameter. FIG. 2 represents one of these ironing rings and illustrates its functioning. The cup (5) is fit with a slight play on the punch (6) which causes it to penetrate the interior of the ring (7) of which the interior diameter is inferior to the exterior diameter of the cup. This results in a thinning and a corresponding elongation of the wall. The magnitude of the elongation or ironing is regulated by the difference between the exterior diameter of the cup and the interior diameter of the ring. The capacity for deformation of the cup not permitting reaching the final height of the can in a single ironing pass, it is usual as indicated above to place three rings in series passed successively by the cup with the same punch stroke.

Among the elements of cost of the beverage can made by the process reviewed above, the cost of the metal, despite it slight weight, constitutes a preponderant portion. The idea had therefore occurred to the researchers of replacing a part of the metal by a less costly material: plastic.

The modulus of elasticity and the elastic limit of most plastic materials being much less than those of metals, the substitution of plastic for metal faces several structural problems. In addition to these structural problems, there are process problems tied to the fact that metal cans are generally fabricated under conditions considerably different from those used for forming plastics. For example, metal containers are normally fabricated at high speed and at ambient or moderate temperatures, whereas the behavior of plastics is such that plastic containers are fabricated normally at lower speed and at higher temperatures.

Previous researchers, in particular as described in WO82/00020, have shown that thin layers of plastic adhering well to a metal foil are able to be formed by simple modifications to the conventional metal forming processes. This can be explained by the fact that the behavior of the metal-plastic construction during forming is controlled by the stronger and thicker metal and by the fact that the stresses generated in the thin plastic layer or layers are easily transferred to the metal foil as a result of their good adherence.

This restriction to relatively thin plastic layers has not been a problem in the previous research because the role of the plastic was in general to protect the metal against corrosion and that a relatively thin layer of plastic suffices for that protection.

Even though WO 82/00020 states that if desired, the laminates may be made with sheet metal or foil bonded to opposed surfaces of the polyethylene film, there is no indication that thicker plastic layers would be desired or possible in such MPM structures. If one constructed MPM structures using the 100 micron plastic film and two metal foils of 210 microns which are described in that patent, the ratio of plastic core thickness to total metal thickness would be less than 0.24. This low ratio, as will be shown, is below that required for the desired cost savings.

In addition to the use of layers of plastic which are thin enough to be dominated in forming by the metal, previous investigators have used two approaches. The first which is illustrated in French Patent FR1414475 and U.S. Pat. No. 4,390,489 is to carry out the forming starting from a heated material as would be used in conventional plastics processes such as thermoforming.

The second approach is to work with metal-plastic constructions in which the respective materials are selected in such a way that the plastic core dominates the forming and the aluminum deformation follows the deformation of the plastic. In EP-A-o 046 444 described previously, this condition is specified in terms of the load borne by the plastic core being greater than that borne by each of the metal strips. This is achieved by use of soft or half-hard aluminum strip and the use of an oriented or stretched plastic layer.

In EP-A-0 034 781, the inventors cold roll the plastic film in order to make it even more dominant compared to a given metal foil. This enables them to use a somewhat stronger metal foil. Although the inventors do not state their results in terms of the percentage of load which is borne by the metal, that percentage can easily be calculated for each of the layered constructions shown in the example under the assumption that the ultimate metal stress if equal to that of the metal foil when tested by itself. This calculation shows that the metal would bear only 16.4% of the tensile load in the construction which uses the cold rolled film and 20.8% in the comparison sample using a thicker layer of the same plastic film without cold rolling. Here too, there is no mention of drawn and ironed containers nor of the ability of the layer construction to undergo successfully the wall ironing process.

In U.S. Pat. No. 3,298,559, the inventors do not cold roll or otherwise orient the plastic but in each of the MPM examples given, they do specify that the aluminum foils are dead-soft or zero temper. In addition, the ratio of plastic thickness to total metal thickness is at least 5 to 1 in each MPM example. Although the inventors do not state the percentage of load taken by the metal nor provide mechanical data from which it can be calculated, this combination of dead-soft aluminum and high plastic to metal thickness ratio dictates that the plastic layer will dominate the forming process.

As will be shown below, the use of soft metal alloys or of a layer of plastic which is very thin compared to the total metal thickness would not meet the objective of the present inventors in providing a major reduction in material cost for a container which must resist, at some point in time, an internal pressure or other significant mechanical load.

The current inventors have also found that an unoriented plastic core layer is preferred over an oriented plastic core in terms of the ability to withstand the deeper draws and, in particular, to withstand the subsequent ironing steps required for drawn and ironed beverage and food cans.

To attain the objective of the present invention which is to reduce the thickness and, therefore, the cost of the metal used, the inventors have found that the plastic layer ought to be placed between two metal layers and ought to be thicker than those attained up until now in the containers made of metal-plastic constructions. It is known in other types of mechanical structures to use a low cost or low density material as a central layer placed between two outside layers made from a stronger and more rigid material. Such sandwich structures are known for achieving a bending resistance approaching that of a single layer of the more solid material of the same thickness as the total thickness of the sandwich.

Even though the less resistant central material contributes to the bending resistance of the structure, it barely contributes to the tensile resistance of the sandwich. This limits the possible reduction of the total thickness of the two external metal layers. The tensile resistance of a structure with relatively thin metal walls such as a container is called membrane strength.

The inventors have found that the pressure at which the base of a rigid container such as a gaseous beverage can start to pass from a concave shape, viewed from the exterior, to a convex shape depends on a complex function of the bending resistance and the membrane strength. This pressure is commonly called bottom buckling pressure. The form of this function of the two types of resistance depends on the exact shape of the concave dome and of the shape of the part of the base which connects the dome to the bottom of the container's wall.

The bottom buckling pressure (P) can be expressed for single layer metal as a function of the thickness by the formula:

$$P=ke^n$$

with k=proportionality constant depending on the material, e=thickness of the material, n=exponent varying between 1 and 2 depending on the geometry of the base. When the exponent n is close to 1, this signifies that the buckling pressure is more sensitive to the membrane resistance; when the exponent is close to 2, this signifies that the bottom buckling pressure is more sensitive to the bending resistance. For most beverage can bases, the exponent lies between 1.2 and 1.9. The closer the exponent is to 2, the less thickness of plastic is required for a given thickness of the external metal layers.

FIG. 3 shows the plastic thickness $e_p$ required for a total thickness of the two metal layers $e_n$ to obtain the same buckling pressure as with an entirely metallic structure with a thickness of 330 microns. As one can observe on the different curves, one needs much less thickness of plastic in the case of an exponent n=1.7 for which the bending resistance is the most critical than in the case of an exponent n=1.2, for which the membrane strength is the most critical.

One can see also on this FIG. 3 that for a given base configuration and, therefore, for a given value of n, there exists a series of plastic thicknesses $e_p$ and corresponding total thicknesses of the two metal layers $e_m$, which will give the required bottom buckling strength. For a configuration with an exponent of 1.5 for example, all the acceptable combinations correspond to the abscissa and the ordinate of each point of the curve designated 1.5.

In general, the points to the left on each curve represent the most economic structures because they incorporate less of the costly metal and more of the low cost plastic.

One should also note that these points have a ratio of the thickness of the plastic to the total thickness of the metal higher than that which has been realized in the prior art.

It was expected that the fabrication, starting with a MPM structure, of containers with the conventional metal forming processes such as drawing and ironing would be relatively more difficult with structures comprised of less metal and more plastic. One reason for this expectation was that, as much during the drawing as the ironing, the MPM structure is submitted to tensile stresses and one would think, according to the existing technology, that the elongation to rupture of the MPM structure would be the same as that of an entirely metal structure. At this elongation, the plastic material, as a result of its low modulus would support a minor portion of the tensile stresses induced by the drawing and ironing. In order to test the commonly accepted assumption of an equal elongation to rupture, the inventors have done uniaxial tensile tests on several structures with varying thickness of plastic and a constant thickness of 100 microns for each layer of the exterior aluminum alloy.

They have been surprised to observe that, as shown on FIG. 4, the elongation to rupture increased with the thickness of the plastic and attained a maximum in the neighborhood of 300 microns of plastic, that is a ratio $P/(M_i+M_e)$ of 1.5.

Although the explanation of this surprising increase in the elongation to rupture is not perfectly clear, the examination of the specimens after rupture shows that it is related to the ability of the plastic to spread the concentration of stresses resulting from the initiation of necking of one of the external metal layers. The plastic distributes the stresses over a large surface of the opposing external layer, thus preventing the necking of the first external layer from propagating to rupture. If the layer of plastic is relatively thin, this concentration of stresses is transferred to a relatively small surface of the opposite external layer which leads to a simultaneous necking of the two layers. If the layer of plastic is thicker than the optimum value, it seems that the plastic is less capable of transferring the stress concentration to the opposite external layer, and the necking proceeds in a sequential fashion in the two metal layers.

The improvement of the toughness of the MPM constructions characterized by their elongation to rupture has permitted successful drawing and ironing MPM structures with relative thicknesses of plastic significantly higher than had ever been achieved. As indicated above, the economic balance for a given bottom buckling pressure is significantly more favorable with such higher thickness of plastic.

Using data from the same tensile specimens as used to produce FIG. 4 in which each metal foil had a thickness of 100 microns and was aluminum alloy 3003 with a tensile rupture strength of 239 $MP_a$, the inventors calculated the portion of the total load which was borne by the metal foil. The percentages varied from 99% with a 55 micron thick core to 82% with a 420 micron thick core.

SUMMARY OF THE INVENTION

In accordance with these and other objects, the present invention provides new and improved metal-polymer-metal laminates and constructions useful for forming can bodies and cans. The nature and the thicknesses of the layers of the laminate are specially adapted to provide the mechanical characteristics demanded of the metal cans intended, in particular, for the packaging of gaseous beverages or food, as well as, to their means of forming by drawing and ironing.

The present invention has equally as objective a process for the fabrication of metal cans intended for the packaging of food products or of beverages by drawing and ironing of metal-plastic constructions of the type MPM.

BRIEF DESCRIPTION OF THE DRAWINGS

FIG. 4 represents the variation of the elongation to rupture of an MPM construction in which each of the external metal foils has a thickness of 100 microns, as a function of the thickness of the central layer of polymer;

FIGS. 5*a* and 5*b* represent two preferred forms of the base of the punch according to the invention.

DESCRIPTION OF THE PREFERRED EMBODIMENTS

Figure 1A:
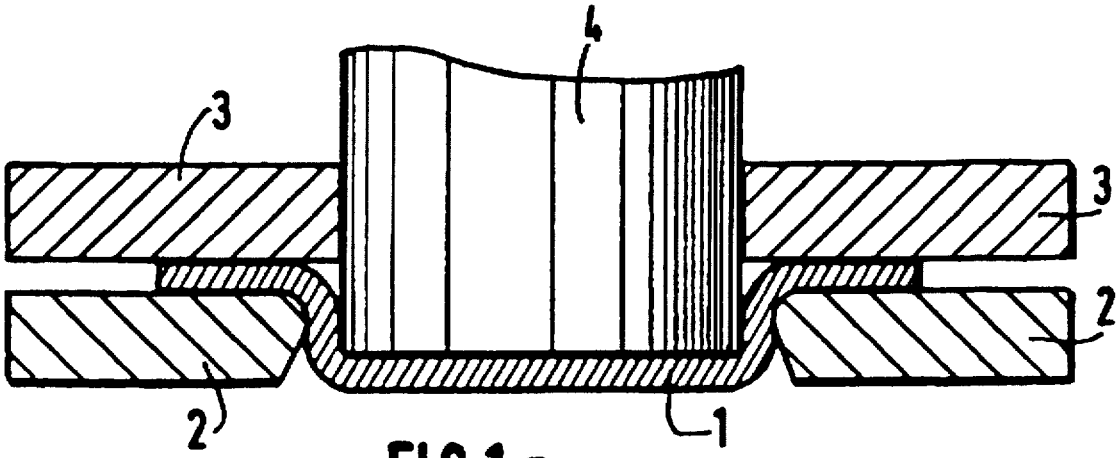
FIGS. 1*a* and 1*b* schematically represent two drawing passes of a circular disc according to the prior art.

Can bodies composed of a base and of a wall in which the generatrice are perpendicular to the base of a metal-plastic construction of the type metal-polymer-metal intended to contain in particular beverages and objects of the invention are characterized in that the metal-plastic construction comprises a central layer of thermoplastic polymer of thickness P coated on its interior and exterior faces with metal foils of respective thicknesses $M_i$ and $M_e$ such that the ratio $P/(M_1+M_e)$ is superior to 0.5 and that the bodies being fabricated by drawing and ironing, their wall is thinned with respect to the bottom of the can body.

Following the same line of explanation of the problem developed above, this ratio $P/(M_1+M_e)$ will be preferably between 0.7 and 2.5 and most preferably between 1 and 2.

In an advantageous method of realization of the metal-plastic construction, the central polymer layer has a thickness before ironing between 100 and 500 microns, each of the metal foils a thickness between 25 and 150 microns before ironing. These thicknesses are evidently less in the thinned walls of the body. In a further advantageous method, this plastic layer is essentially non-oriented other than incidental orientation normally produced during the casting or blowing of a plastic film.

The polymer constituting the central layer is chosen among one of the following thermoplastics: polypropylene, high and low density polyethylenes, polyesters and polyamides. It is interesting to note that, the polymer not being in contact with the food product or the beverage contained within the container, it is possible and recommended to use recycled polymers. Trials have been made with recycled polyesters and polypropylene and give completely satisfactory results.

The metal is either steel, tin plated or not, coated with chrome, zinc, nickel, or of chrome-chrome oxide, or of aluminum or an alloy of aluminum, aluminum alloys being preferred. It is further preferred that the rupture strength of the metal foil when tested alone and in tension be greater than 185 $MP_a$.

The selection of the specific materials and the thicknesses of the layers is preferably such that, when the starting sheet is pulled in uniaxial tension, most of the load is borne by the combined metal layers. More preferably, the percentage of the load which is borne by the combined metal layers should be greater than or equal to 70%.

The metal foils can be of different thicknesses or constituted of different metals. One could, for reasons explained later, use a metal foil corresponding to the exterior of the can thicker than that which corresponds to the interior of the can or choose for the foil corresponding to the interior of the can an alloy having a better corrosion resistance and for the foil corresponding to the exterior of the can an alloy having better mechanical strength.

A layer of appropriate adhesive of a thickness between 1 and 20 microns can be interposed between the central layer of polymer and the foil or foils of metal, the thickness of the adhesive being included in the total thickness of polymer P.

The adhesive interposed between polymer and metal is either a thermoset polymer, for example a polyurethane or an epoxy, or a thermoplastic polymer such as polyolefins modified in a classical fashion by an ethylenic acid (malic, crotonic, etc.) ethylene acrylics (EAA), polyesters or copolymers of the monomers corresponding to the above indicated polymers.

The adherence of the metallic foils to the central polymer layer is evidently an important characteristic of the metal-plastic constructions and of the can bodies produced from these constructions. This adherence is measured by the peel strength, the force necessary for detaching a band of metal foil of determined width from its polymer support and which is expressed, therefore, in force per unit length. The constructions intended for the production of drawn and ironed can bodies ought to have a peel strength higher than 0.4 newtons per millimeter.

The metal-plastic constructions can themselves be coated on one or both sides with a varnish or a polymer film without parting from the framework of the present invention.

Another object of the invention concerns the finished cans prepared starting from the bodies or forms of which the characteristics are indicated above. To fabricate a can starting from a can body, one first proceeds to trim the body to height by shearing the upper part of the walls, then to neck this upper part. The upper edge ought to be then rolled to a small radius of curvature to permit the seaming of the end after filling the can. Because, in the course of this operation of bending the metal-plastic construction according to this small radius, one observes that the metal foil the farther from the center of curvature, that which is in extension, breaks at the point where the radius is the smallest, the other metal foil remaining intact. This phenomenon, for reasons which it would take too long to explain here, does not occur with a homogeneous metal of the same thickness without a polymer layer. Faced with this problem, the inventors have first of all searched for a solution, then have rapidly set forth the hypothesis that this rupture of the metal foil in extension had no effect on the mechanical strength of the can which had been filled and seamed. What could be feared, in effect, is that a can with a rolled flange in which one of the two metal foils is ruptured would not be able to resist the tensile stresses created by the internal pressure which tends to detach the end. However, the internal _stresses in the axial direction of a pressurized cylinder are approximately half of those in the direction perpendicular to the axis. Thus, if there is enough metal in the complete metal-plastic construction, with its two layers of metal, to resist the stresses in a plane perpendicular to the axis, there is enough metal in the remaining intact layer to resist the axial stresses. This hypothesis has been confirmed by calculations. Moreover, the total thickness in the brim is, in general, higher than that of the thinnest part of the wall, which gives a margin of safety. It is also possible for reinforcing the can to choose for the external foil a higher thickness or a stronger alloy than for the internal layer. Finally, the exterior appearance of the can will not be affected since the broken part of the metal foil will be covered by the folded edge of the end in such a way that the final user of the can will not even notice it. A final can of metal-plastic metal-polymer-metal, possessing an upper rolled border in which the metal foil the greater distance from the center of curvature, which is therefore in extension, is ruptured at the location where the radius is the smallest constitutes a second object of the invention.

Besides the technique of seaming, it is equally possible to attach the cover to the metal-plastic can by any other known technique; heat sealing, gluing.

The invention concerns equally a process for fabricating drawn and ironed cans intended for the packaging of beverages characterized in that it includes the following steps:

a) Preparation of a strip of metal-plastic construction including successively a metal layer, a thermoplastic polymer layer, a second metal layer, a layer of polymer adhesive being able to be interposed between each metal layer and the polymer layer.

b) Cutting circular discs from the strip.

c) Drawing the discs to give cups in two successive passes, each of the two passes being made preferably with a cylindrical punch having a circular base in which the generatrice are connected on the base by a radius of curvature between 5 and 10 millimeters and the second pass being made preferably with an entry angle of the fixed platen with the horizontal between 10 degrees and 70 degrees.

d) Ironing of the wall of the cups thus obtained by means of a series of ironing rings preferably 4 in number of which the first, called calibration, diminishes the wall thickness only by between 2 and 25%.

The metal-plastic construction objects of step a of the invention are prepared by different known methods. The most commonly used are direct co-extrusion, thermal sealing, and induction gluing. These last two methods are preferably practiced on a continuous line fed with plastic films and metal strips.

Direct co-extrusion consists of extruding between the two metal foils which are unrolled continuously and which constitute the external layers, the central polymer layer on one side and the others of this central layer the two thin layers of adhesive. The composite product thus obtained passes then between the rollers in order to achieve the adherence between the different layers. This technique evidently applies just in the case of thermoplastic adhesives.

Heat bonding consists in starting with a composite strip of polymers including a central layer of polymer coated on each of its faces by the adhesive layer, here also thermoplastic, and of introducing this strip between two metal foils. The heat bonding is assured by the passage of the composite product thus obtained between two rolls heated to a temperature sufficient to melt or at least soften the adhesive layer sufficiently in a fashion to guarantee the adhesion between the polymer core and the metal foils.

Finally, the gluing by induction consists of coating the inside faces of the two metal foils with a thermosetting adhesive by a known method and applying these foils from one side and the other on the strip of central polymer with the aid of rollers.

Figure 1B:
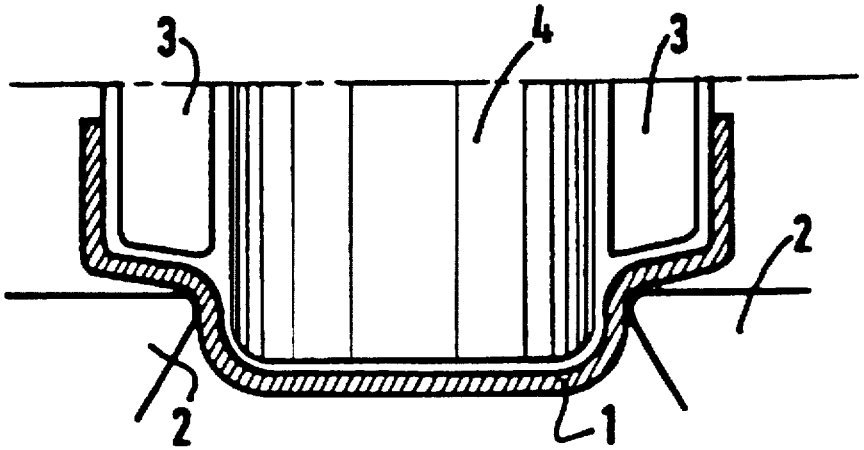

The forming of the cans includes a first step c consisting in general of one or several successive drawing passes in using a device such as that represented in FIG. 1. In order to adapt the operating conditions to the particular case of metal-plastic constructions of the MPM type, the inventors have been led to prefer one particular shape of punch base and of entry shape of the die plate which work together to assure a drawing of the construction without forming cracks, wrinkles or delaminations.

The punch, of a general shape of a cylinder of revolution, presents, according to one of the preferred methods of the invention, an axial section of which the generatrice are connected at the base of the punch by a circular arc of a radius between 5 and 10 mm. This connection can be done directly on the base of the punch or by an intermediary, seen in section of a second circular arc of which the center lies on the axis of revolution of the punch. FIGS. 5*a* and 5*b* illustrate the two variations indicated above.

FIG. 5*a* represents the simplest shape of the embodiment. The punch 9 is viewed in section through the axis; it takes the shape of a cylinder of revolution about the axis 10. The generatrix 11 is connected to the base by a circular arc of radius R1 which falls between 5 and 10 mm (8 mm for example for punch with a diameter of 85 mm). This circular arc generates by revolution a portion of a torus.

FIG. 5*b* represents a developed shape a little more complicated; the generatrice are joined on the base by a first circular arc 14 of radius R1 between 5 and 10 mm which connects tangentially to a second circular arc of large radius R2 (15) centered on the axis of the punch. The circular arc (15) generates a spherical dome and the circular arc (14) a portion of a torus. By way of example, R1 could be in the order of 6 mm and R2 in the order of 250 mm.

Figure 6:
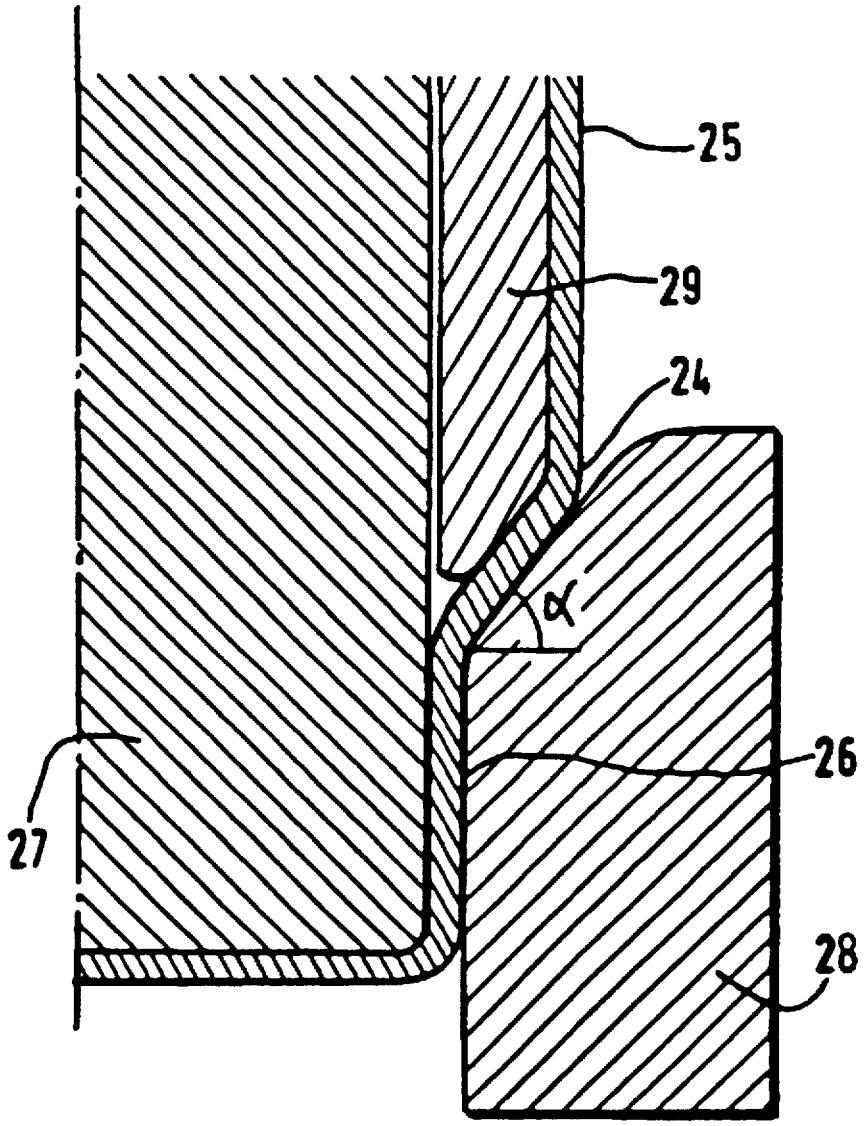
FIG. 6 represents mold components for the second drawing pass according to the invention.

The other preferred method of the invention, cooperating with the particular shape of the punch described above, is the shape, also particular, of the entry of the die plate utilized for the second drawing pass. Normally, drawing die plates have the shape represented schematically in FIG. 1*a* which represents the first drawing pass starting from a flat circular disc as has been explained above. FIG. 6 represents the following drawing passes according to the invention of which the starting material is no longer a disc but a shape already drawn during the course of the first pass. The cup (24) is in the process of drawing, its initial diameter corresponding to the upper part (25) is in the process of reduction towards its final diameter (26) defined by the space between the punch (27) and the die plate (28). Correspondingly, the height of the walls grows without that there be an ironing in the normal sense of the word, that is a significant reduction of the thickness. An inside pressure plate (29) is positioned at the interior of the starting cup.

The inventors have found that the angle at which the generatrix of the entry cone makes with the horizontal plane perpendicular to the axis of the punch is critical for drawing metal-plastic constructions of type MPM. This angle ought to be between 10 degrees and 70 degrees and preferably around 60 degrees.

Figure 2:
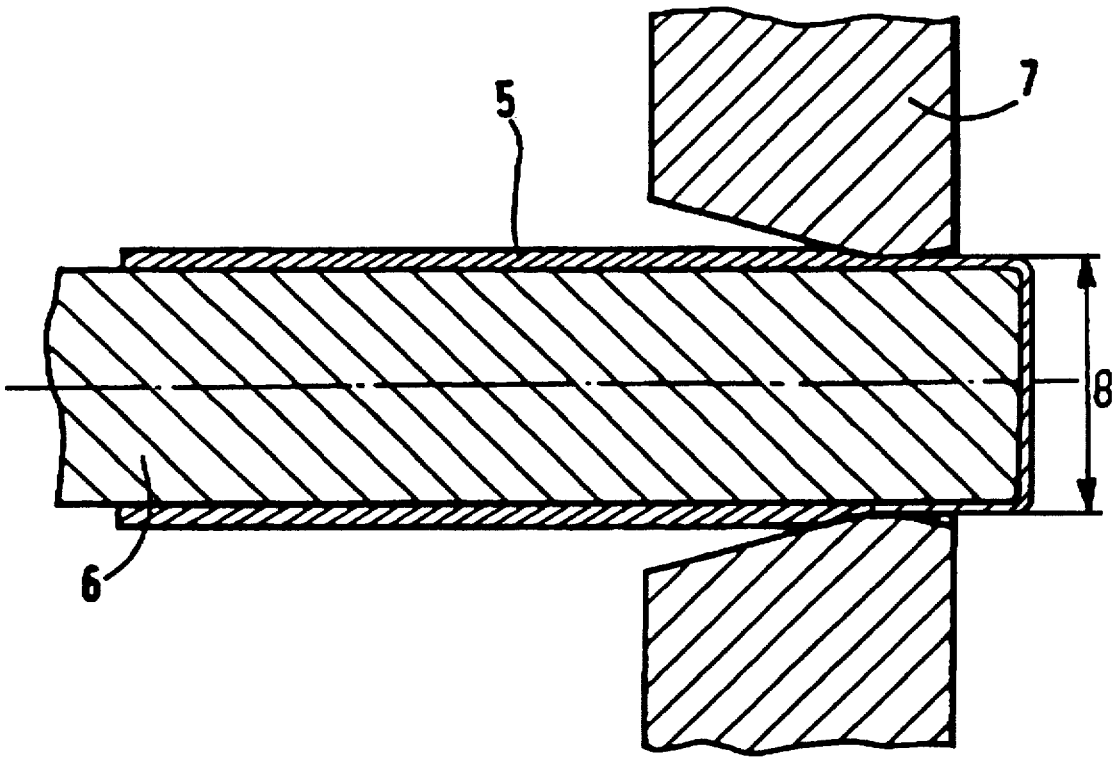
FIG. 2 represents ironing of the wall of a drawn cup for making it into a can.
Figure 3:
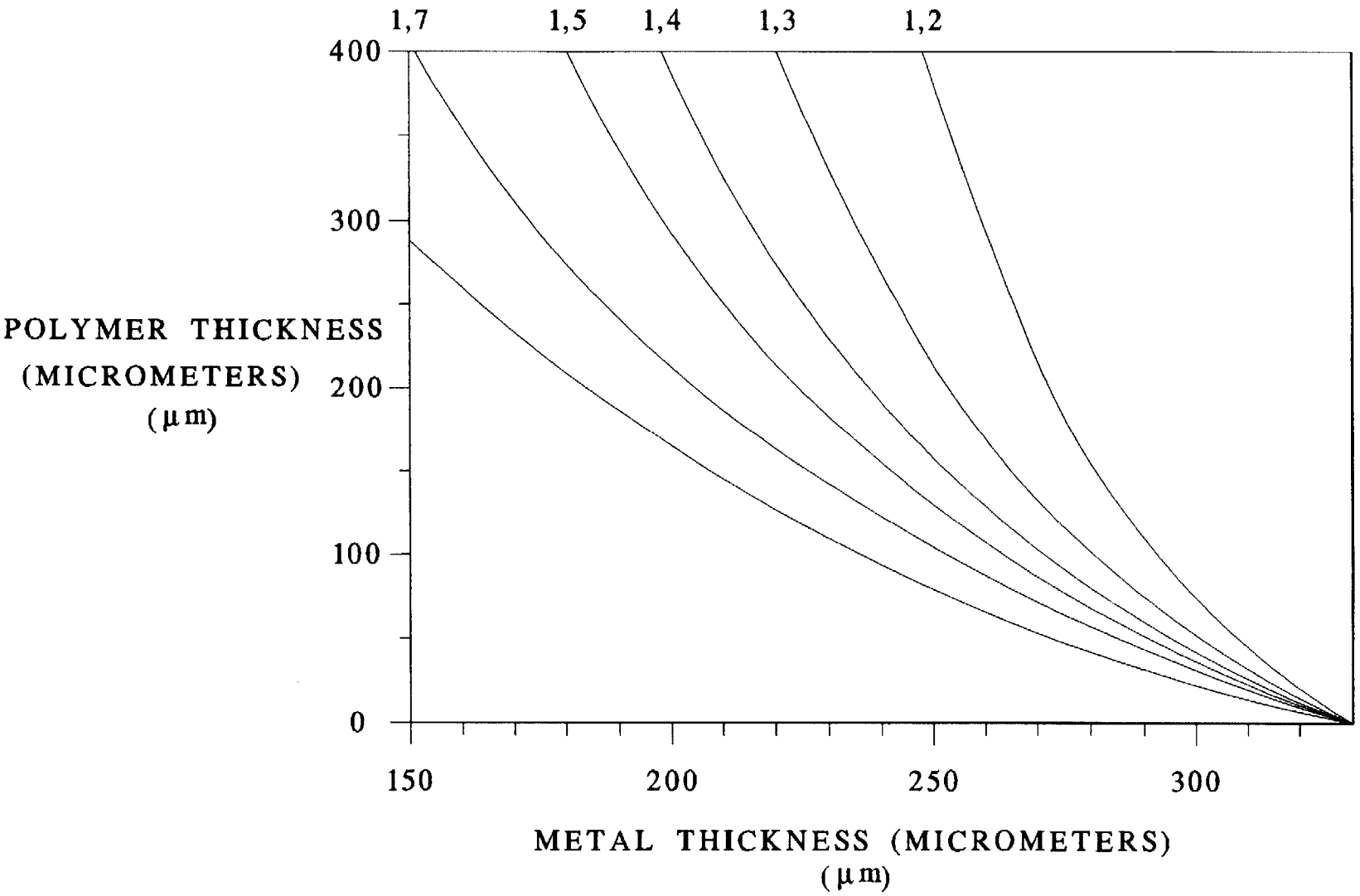
FIG. 3 represents isobars for the bottom buckling pressure P, the total thickness of the metal $e_m$ being the abscissa and the thickness of the intermediate polymer layer $e_p$ being the ordinate.

The forming of cans includes a last step (d), consisting of an ironing operation permitting the elongation of the wall with a corresponding thinning of the wall. This operation is represented schematically in FIG. 2.

The applicant has discovered that it was possible to iron the walls of a cup drawn from an MPM disc without engendering flaws such as cracks and delaminations, preferably by processing in four successive ironing passes instead of the three generally practiced in particular according to the teaching in European Patent Application EP 0402006. More preferred still, the first of these successive passes is a simple calibrating pass with a rate of thickness reduction between 2 and 25%.

The examples which follow illustrate, on particular cases, the different steps of the invention.

EXAMPLE 1

A strip of polypropylene of 300 microns thickness has been coated on each of its faces with a layer of 10 microns in thickness of an adhesive consisting of a film of maleic acid modified polypropylene. The two films of adhesive have been applied on the film cold by passing between two rolls. The composite strip thus obtained has been then introduced continuously between two foils of 100 micron thick aluminum alloy 3003, a manganese alloy according to the standards of the "Aluminum Association", each unwound from a bobbin and preheated by passage through an oven at a temperature of 200° C. in a fashion to melt the adhesive. The MPM construction obtained was then passed between the rollers exerting a pressure of around 4000 Kpa, then rolled onto a bobbin. Starting from this construction, circular discs of 140 mm in diameter were cut out. These discs have been then drawn in two successive passes with the aid of a punch analogous to that represented in FIG. 5*a* with R1=8 mm. For the second drawing pass, a die plate for which the angle alpha was 60° has been used. The first pass has given cups with an outside diameter of 86 mm and a height of 35 mm. The second pass has given cups with an outside diameter of 67 mm and a height of 56 mm. These cylindrical cups carried by a punch have finally been ironed by passage through a tool including a series of four rings of successively smaller diameters to give cups of beverage cans of 66 mm in diameter and 130 mm in height. The respective reductions in wall thickness express in % of the initial thickness are the following: 20%, 40%, 52% and 57%. Careful examination of these cups have not shown evidence of any cracks of the metal or of the plastic. No delamination between the metal and the plastic has been observed.

EXAMPLE 2

A composite MPM strip has been prepared by coextruding between two foils of the same 3003 alloy as in Example 1, but of a thickness of 80 microns, a core comprised of polypropylene in 250 microns of thickness and on one side and the others of this core a layer of adhesive comprised of maleic acid modified polypropylene of 10 microns in thickness. The adhesion has been achieved by passage between two rolls heated to 200° C., while applying a pressure of 4000 Kpa. Some beverage bottle cups have been fabricated under the same conditions as in Example 1. The examination of these cups has shown no cracking of the metal or of the plastic. No delamination between the metal and the plastic has been observed.

EXAMPLE 3

An MPM composite strip has been prepared by coextrusion under the same conditions and with the same component as those in Example 2, but in using for the core polypropylene recycled from cans fabricated with this same MPM construction. Even though the recovery of the polypropylene from the used cans did not permit the separation of the adhesive from the polymer, the constructions obtained were of excellent quality and did not show either cracks or delamination. Beverage can cups have been produced under the same conditions as for Example 1. The examination of these cups has not exhibited any cracks of the metal or of the plastic. No delamination between the metal and the plastic has been observed.

EXAMPLE 4

Under the same operational conditions as those of Example 2, a MPM construction has been fabricated comprising successively: a foil of 3003 alloy of 80 microns in thickness, a layer of adhesive of amorphous polyethylene terephtalate of 10 microns in thickness, a layer of polyethylene terephtalate of 200 microns in thickness, another layer of amorphous polyethylene terephtalate of 10 microns of thickness, finally another foil of 3003 alloy of 80 microns in thickness. The beverage can cups have been fabricated under the same conditions as in Example 1. The examination of these cups has not shown any cracks of the metal or of the plastic. No delamination between the metal and the plastic has been observed.

EXAMPLE 5

Example 5 concerns the same fabrication of cups as in Example 4, with the comparative difference that the polyethylene terephtalate used came from the recovery of used plastic bottles. These bottles, after washing and drying, have been ground and have been introduced in the feed hopper of the extruder. No quality problem has been observed either on the construction or on the cups obtained by drawing and ironing.

We claim:

1. A drawn and ironed can body comprising a base and an upstanding sidewall, the base and the sidewall having an $M_i$-P-$M_e$ type laminar construction, wherein $M_i$ and $M_e$ are inner and outer metal foil layers, respectively, P is a central polymer layer and the ratio of the thicknesses P/$M_i$ and $M_e$ is greater than 0.5, the thickness of the sidewall being thinner than the thickness of the base, and in the base of the can body the thickness of the polymer layer P is between 100 and 500 microns and the thickness of each of the metal layers $M_i$ and $M_e$ is between 25 and 150 microns.

2. A can body according to claim 1, characterized in that the ratio P/($M_i$+$M_e$) is between 0;7 and 2.5.

3. A can body according to claim 2, characterized in that the ratio P/($M_i$+$M_e$) is between 1.0 and 2.0.

4. A can body according to claim 1, intended to contain beverages.

5. A can body according to claim 1, characterized in that the peel strength of the metal layers to plastic layers in the laminar construction is greater than 0.4 N/mm.

6. A can body according to claim 1, wherein $M_i$ and $M_e$ are metal foils independently selected from foils of steel, tin-plated steel, steel coated with chrome, zinc or nickel, chrome-chrome oxide coated aluminum and aluminum alloys.

7. A can body according to claim 6, characterized in that the metal foils $M_i$ and $M_e$ are made of an aluminum alloy.

8. A can body according to claim 1, wherein polymer layer P comprises a thermoplastic polymer selected from the group consisting of polypropylene, high density polyethylene, low density polyethylene, polyesters, and nylon.

9. A can body according to claim 1, wherein polymer layer P includes a recycled polymer.

10. A can body according to claim 1, further comprising: a layer of adhesive selected from thermosetting polymer adhesives based on polyurethane and epoxy adhesives and having a thickness of between 1 to 20 microns is interposed between the central polymer layer P and each metal foil layer $M_i$ and $M_e$, the thickness of adhesive layers being included in the total thickness of polymer P.

11. A can body according to claim 1, further comprising a layer of adhesive having a thickness between 1 and 20 microns interposed between the central polymer layer P and each of the foil layers $M_i$ and $M_e$, the thickness of adhesive being included in the total thickness of polymer P, and said adhesive being selected from the group consisting of polymers derived from ethylenically unsaturated carboxylic acids, copolymers derived from an olefin and an ethylenically-unsaturated carboxylic acid, and polyesters.

12. A can body as in claim 1, wherein the metal foils $M_i$ and $M_e$ are different materials, such that $M_i$ is a metal foil having good corrosion resistance and the outside foil layer $M_e$ is selected from metal foils having good mechanical strength.

13. A can body as in claim 1, wherein the sidewall portions includes an upper rolled region in which the metal foil $M_i$ is in extension and is ruptured at the location where the radius of curvature is the smallest.

14. A can body according to claim 1, characterized in that the metal foil layer $M_e$ forming on outside surface of the can body is thicker than foil layer $M_i$ forming on inside of the can body.

15. A method for making can bodies having reduced metal content, said method comprising:

providing a sheet of an $M_i$-P-$M_e$ laminate, wherein $M_i$ and $M_e$ are inner and outer metal foil layers, respectively, and P is a central polymer layer and the ratio of the thicknesses $P/(M_i+M_e)$ is greater than 0.5';

cutting discs from the sheet;

drawing the discs in at least one drawing pass to form a cup;

ironing the cup in at least one ironing pass to form a can body including a base portion and an upstanding sidewall portion, the upstanding sidewall portion having an overall thickness less than the base portion from drawing.

16. A method as in claim 15, wherein the ratio $P/(M_i+M_e)$ is between 0.7 and 2.5.

17. A method as in claim 15, wherein the ratio $P/(M_i+M_e)$ is between 1.0 and 2.

18. A method as in claim 15, wherein the drawing step includes a plurality of drawing passes.

19. A method as in claim 15, wherein in the laminate sheet, the central polymer layer P has a thickness of between 100 and 500 microns and each of the metal foils $M_i$ and $M_e$ independently has a thickness of between 25 and 150 microns.

20. A method as in claim 15, wherein $M_i$-P-$M_e$ laminate sheet further comprises an adhesive layer having thickness of between 1 and 20 microns interposed between the central polymer layer P and the metal foil layers $M_i$ and $M_e$, the adhesive thickness being included in the total thickness of polymer P.

21. A method as in claim 15, wherein in the laminate, polymer layer P is a thermoplastic polymer selected from the group consisting of polypropylenes, high density polyethylenes, low density polyethylenes, polyesters and polyamides.

22. A method as in claim 20, wherein the adhesive is a thermosetting polymer selected from polyurethane epoxy-based adhesives.

23. A method as in claim 20, wherein the adhesive is a thermoplastic polymer selected from ethylenically unsaturated carboxylic acid or acid anhydride modified polyolefins selected from polyethylenes and polypropylenes, copolymers of olefins with acrylic acid, polyesters and polyester copolymers.

24. A method as in claim 15, wherein metal foil layers $M_i$ and $M_e$ are each independently selected from steel, chrome or tin-plated steel, aluminum and aluminum alloy foils.

25. A method as in claim 15, wherein the metallic foil $M_e$ on the exterior of the sidewall of the body is thicker than the $M_i$ foil layer on the inside of the sidewall of the can body.

26. A method as in claim 15, wherein in the drawing step at least two drawing passes are made using a cylindrical punch with circular base in which the generatrice are blended on the base by a radius of curvature between 5 and 10 mm and the second pass is done with an angle of entry of the die plate and the horizontal between 10° to 70°.

27. A method as in claim 15, wherein in the drawn and ironed can body the circular arc linking the generatrices of the punch to the base merge on a second circular arc centered on the axis of the punch.

28. A method as in claim 15, wherein in said ironing step, the ironing of the drawn cup is accomplished with the aid of four successive ironing rings, of which the first only calibrates the cup, that is achieves a reduction of wall thickness of the cup of only between 2 and 25%.

29. A can body according to claim 1, wherein at least one of the metal foils $M_i$ and $M_e$ is of a material whose tensile rupture strength is greater than 185 Mpa.

30. A can body according to claim 1, in which most of the load is borne by the combined metal layers $M_i$ and $M_e$ when the sidewall is elongated uniaxially.

31. A can body according to claim 1, wherein at least one of the metal foils $M_i$ and $M_e$ is of a material whose tensile rupture strength is greater than 210 MPa.

32. A can body according to claim 1, wherein the polymer layer P is essentially unoriented.

* * * * *